United States Patent [19]

Zangheri

[11] Patent Number: 4,644,731

[45] Date of Patent: Feb. 24, 1987

[54] METHOD AND EQUIPMENT FOR THE AUTOMATIC INSERTING OF ENCODED CARDS INSIDE ENVELOPES, AND RELATING ENVELOPE MODULE

[75] Inventor: Carlo Zangheri, Milan, Italy

[73] Assignee: FIMA S.p.A., Milan, Italy

[21] Appl. No.: 719,120

[22] Filed: Apr. 2, 1985

[30] Foreign Application Priority Data

Apr. 3, 1984 [IT] Italy ..... 20370 A/84

[51] Int. Cl.[4] ..... B65B 61/26

[52] U.S. Cl. ..... 53/411; 53/53; 53/131; 53/266 A

[58] Field of Search ..... 53/266 A, 411, 53, 54, 53/131, 154, 479

[56] References Cited

U.S. PATENT DOCUMENTS

| | | | |
|---|---|---|---|
| 4,034,210 | 7/1977 | Hill et al. | 53/266 A |
| 4,139,978 | 2/1979 | Jensen et al. | 53/53 |
| 4,205,504 | 6/1980 | Gregoire et al. | 53/266 A X |

*Primary Examiner*—James F. Coan

*Attorney, Agent, or Firm*—Charles E. Brown; Charles A. Brown

[57] ABSTRACT

A method and apparatus for automatic insertion of encoded cards into envelope-modules. The envelope-modules are formed as part of a continuous strip. The envelope-modules are discharged from the apparatus sealed and ready for dispatch in the mail containing pre-printed cards with the envelope-modules being printed in accordance with the indicia on the pre-printed cards.

24 Claims, 5 Drawing Figures

30
31
32
33
34
35
36
37
39
40
42
43
44
45
46
47
48
49
50
51
52
53
54
55
56
57
58
59
26
25
12
13
11
II 30
31
54
55
52
51
38
49
33
40
35
34
32
33
39
41
43
42
12
11

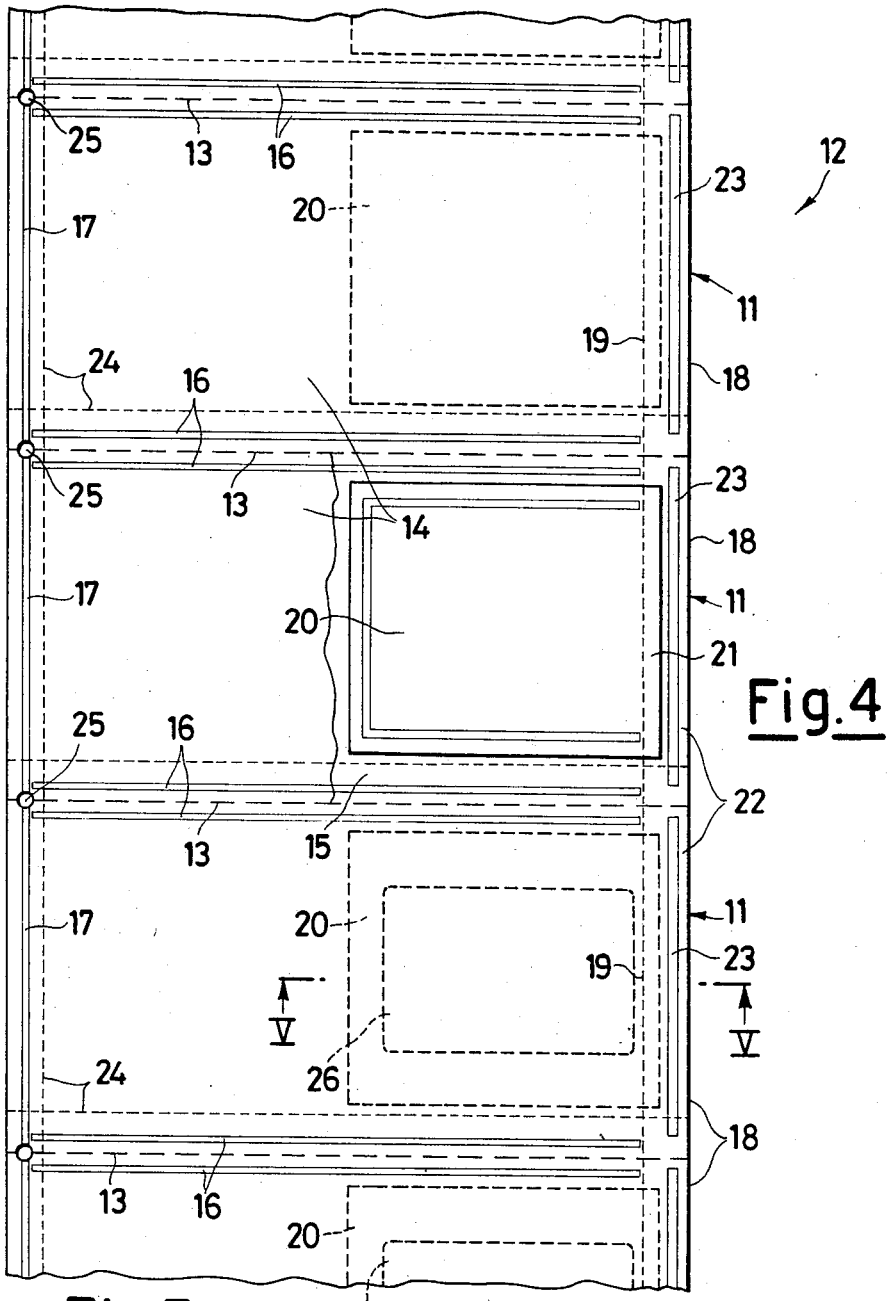
Fig.4
Fig.5
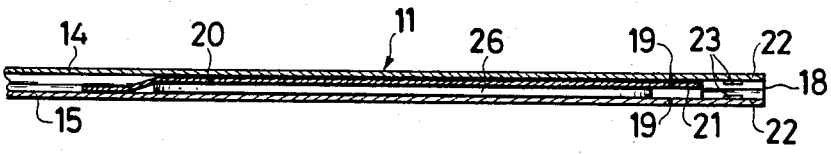

METHOD AND EQUIPMENT FOR THE AUTOMATIC INSERTING OF ENCODED CARDS INSIDE ENVELOPES, AND RELATING ENVELOPE MODULE

The present invention relates to a method and to the related equipment, suitable to carry out the automatic positioning of encoded cards inside envelope-modules, denominated preformed modules, and forming a part of a continuous modular strip; the sealing of said envelope-modules, containing the encoded card and externally bearing the previously printed address; and the separation of the various finished envelope-modules, ready for dispatch.

It should be specified that by the general term "encoded card", plastic cards, credit cards, identification cards, labels of metallic materials or others are hereinunder meant, which are encoded by means of methods or ways such as punching, magnetic encoding, laser writing, bar code, chip card, and so on.

The production and the use of the so-defined encoded cards are frequently associated with the need of resorting to suitable inserting systems of the same, inside the envelopes, to the purpose of prearranging for them to be dispatched by mail to the end user.

Mainly two types are known of inserter machines intended for inserting encoded cards inside envelopes:

(a) machines operating in direct, mechanical and electrical connection, with the punching systems of the encoded cards, which are therefore inserted inside the envelopes at the same time of their production;

(b) machines intended for autonomous operation, in which in other terms the encoded cards to be inserted inside the envelopes have been previously produced by means of punching systems, physically independent from the inserter machine.

In the equipment of the first type, the encoded card is inserted inside a suitable housing consisting of two oblique slits cut in a special module. After the inserting of the card, the module—on which the same machine has already printed the address of the adressee, and/or other optional messages—is cut, folded, and then inserted inside a common window-envelope.

The inserted machine does not seal the envelope, which, therefore, is to be manuall y sealed and stamped, or sealed or stamped by means of some other equipment, before being dispatched by mail. The main drawbacks of this kind of solution can be summarized as follows:

the process is not complete, in that the envelope is not ready to be dispatched, it being still open;

the method is on the overall quite complex, both due to the great number of operating steps which must be carried out (inserting of the card in the module, cutting of the module, folding of the module, inserting of the folded module inside the window-envelope), the relating equipment being consequently complex, as to each step adequate mechanical and electrical controls are to be associated to the purpose of warning about possible cloggings, and because three different components are to be fed (the card, the module and the envelope), each one of which being subjected to become exhausted during the running of the various steps.

In the second type of equipment, the machine is equipped with a suitable loader for the punched and ready to be dispatched cards; it is moreover fed by a continuous module, at all similar to the already described one, on which, however, and differently to the preceding method, the address of the addressee has already been previously printed.

The equipment carries out the inserting of the card in the module only. To this purpose, two preliminary operating steps are required:

to place the cards inside the loader according to a rigidly predetermined sequence, said sequence being in particular, identical to the sequence of the addresses printed on the continuous module;

to affix on the module a particular identification code, which, in association with an information contained on the card (typically, the sequence of the OCR characters punched of the first one of its lines), allows coupling mistakes to be avoided between said cards and the same module.

After the card has been inserted, the machine cuts and folds the module.

The step of inserting the module inside an envelope is not carried out, and it is therefore necessary to resort to the use of other properly inserter machines. Even if such second solution is simplier, due to the smaller number of items to be coupled and handled, which are in this case the card and the module only, it suffers from many drawbacks:

the module to be printed by means of a different machine, and a special identification code to be affixed on it;

a complex check control to be carried out of the conditions which are necessary to the coupling, on the basis of the identification of the special code;

such a process is not complete, in that the module, after having been folded, has to be inserted inside the window-envelope, by means of a different machine.

It must be finally added, that both the aforementioned solutions of known method and equipment do not have, but partly, the necessary requisites of reservedness, which are normally at the basis of the mailing of credit documents. The use indeed of a window-envelope does not prevent one, who's willing to do so, to appropriate the card and to later on send it to the lawful consignee, without any difficulties.

Purposes of the present invention are to provide a method and an equipment for inserting encoded cards inside envelopes which are integrated, that is, capable to operate being directly connected to a punching machine, complete, that is, allowing a finished product to be obtained which is ready for being dispatched by mail, and simple, that is, which involve the coupling of two items only, i.e., the module and the encoded card.

These and further purposes, according to the present invention, are achieved by providing a method for the automatic inserting of so-called encoded cards inside envelopes, comprising the sequential steps of:

to automatically feeding a continuous strip of envelope-modules with a step-by-step movement, to at the same time feed encoded cards to be inserted within said envelope-modules, to print the address or additional data on the outside of the single envelope-module, corresponding to at least an encoded card to be inserted;

to insert at least one encoded card within the related envelope-module, to seal the open sides of said enevelope-module.

Said method is preferably carried out by means of an equipment comprising, on a supporting structure, transportation and feeding means for feeding said cards towards a supporting plate, on which said continuous strip of envelope-modules is fed, means being provided to the purpose of inserting said single cards inside related pouches of said envelope-modules, means for verifying that the inserting did really take place, sealing means for open edges of said envelope-modules, means for separating the single envelope-modules from said continuous strip, means being additionally provided for moving said strip step by step, operatively connected and coordinated with means for actuating the single operative parts, and means for checking and verifying the single operating steps being provided too.

Said equipment and said method preferably use an envelope-module, forming a part of a continuous strip, essentially comprising an upper portion and a lower portion, joined to each other along at least two pasted sides, the other two sides showing open edges, means being additionally provided to the purpose of defining a stable housing area for housing at least one of said cards.

The characteristics and the advantages of a method, an equipment and a module according to the present invention will be better comprised from the exemplifying and not limiting following description, relating to the schematic drawings attached, in which:

FIG. 4 is a plan, partly sectional, view, of a portion of the strip of envelope-modules according to the invention, and FIG. 5 is an enlarged sectional view following the line V—V of FIG. 4.

Figure 1:
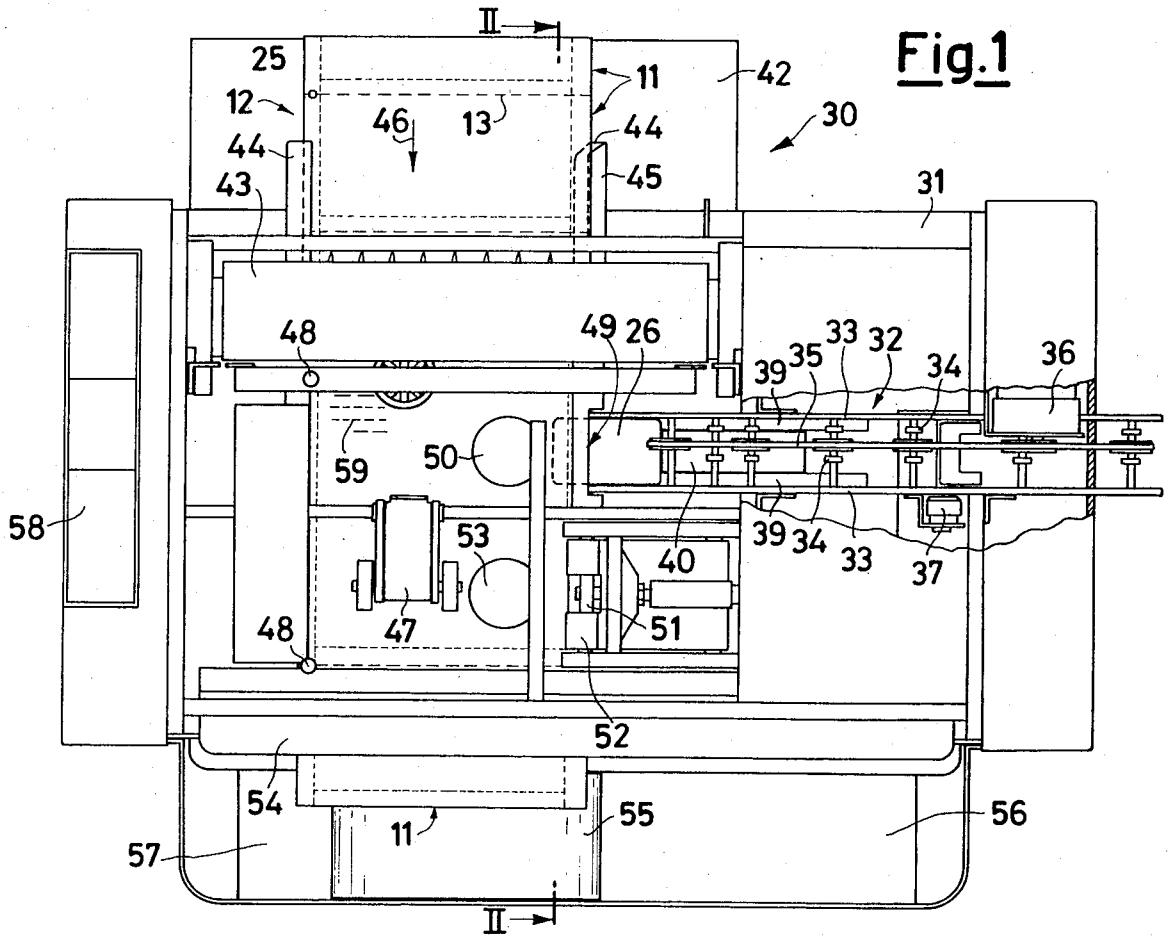
FIG. 1 shows a partly in section plan view from the top of an equipment according to the present invention.
Figure 2:
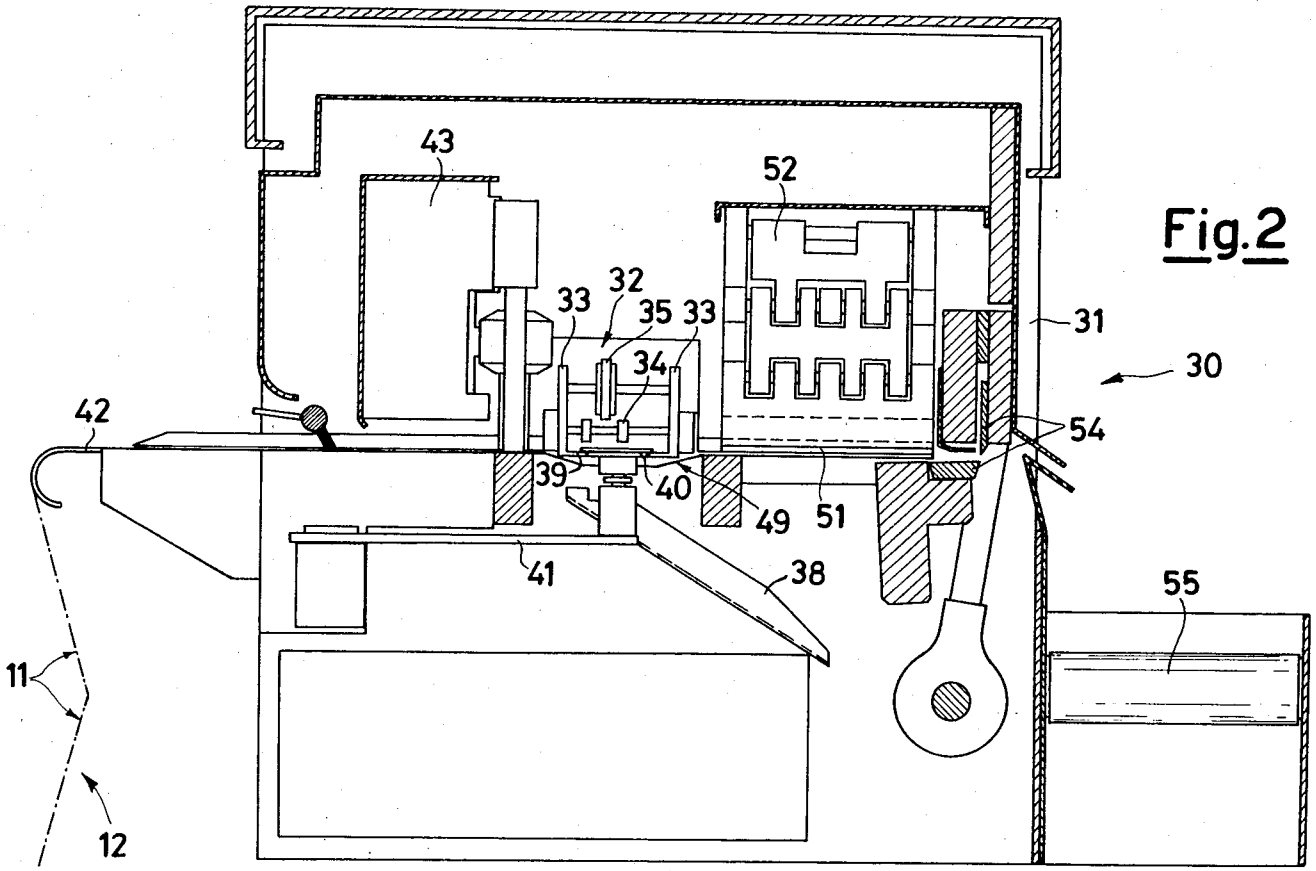
FIG. 2 is a schematic sectional view following the line II—II of FIG. 1.
Figure 3:
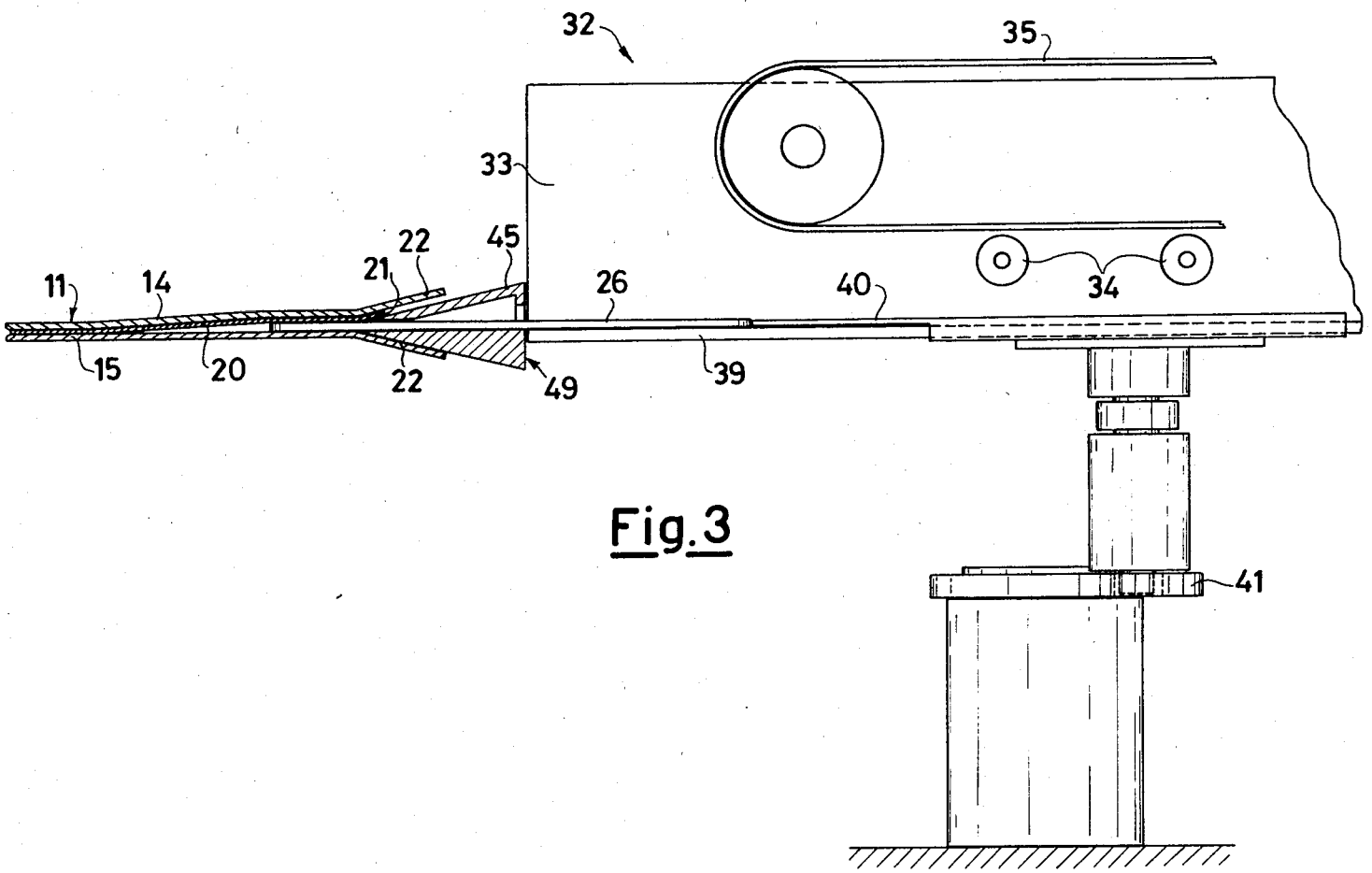
FIG. 3 is a schematic sectional elevation view of a particular of the very inserting zone.

Referring to FIGS. 4 and 5, a series of envelope-modules indicated with 11, forming a part of a continuous strip 12, are joined to each other along pre-cut lines 13, which act as invitation lines for the folding and the mutual separation of the modules.

More precisely, each one of said modules 11, which are also denominated as preformed modules, comprises an upper portion 14 and a lower portion 15, which are connected to each other by means of two pasting longitudinal lines 16 and a transverse pasting line 17, which seal three of their sides.

The fourth transverse side 18, defined by a pre-cutting line 19 is open and shows a pouch 20, positioned on the lower portion 15, such pouch being e.g. of tissue paper, it too being open, and being slightly protruding with an edge 21 towards edges 22 of the open side 18, such edges being provided with lines of smeared glue 23, suitable to be joined and sealed to each other, e.g., by heating.

The other transverse side and a longitudinal side too have pre-cutting lines 24, which allow the pasting lines 16 and 17 to be carried away, and the envelope-module 11 to be opened.

Holes 25 too may be present on a transverse edge of the strip 12, which cooperate to the purpose of its positioning during the inserting operation inside the proper equipment.

A strip 12 indeed, composed by envelope-modules 11 according to the present invention is used to the purpose of stably housing the so-called "encoded cards" 26, previously illustrated, and outcoming, e.g., from a punching device (not shown).

A method according to the present invention for inserting encoded cards 26 inside envelope-modules 11 of a continuous strip 12 comprises essentially the following operations:

to automatically feed a continuous strip of envelope-modules, with a stepwise movement;

to feed at the same time encoded cards to be inserted inside said envelope-modules;

to print the address or other data on the outside of the individual envelope-module, corresponding to at least one encoded card to be inserted;

to insert at least one encoded card inside the relative envelope-module;

to verify the insertion of said card inside its pertinent envelope-module;

to close and to seal the open sides of said envelope-module.

In a preferred method, the envelope-module being formed may easily be personalized, by printing written messages, notices or advertising messages inside its interior.

The single envelope-modules, moreover, after the encoded cards have been inserted inside them, and they have been sealed, are separated from each other by cutting or tearing the continuous strip, being thus ready for being dispatched.

A method so disclosed according to the present invention may be practically carried out by means of an inserter machine of the type which is hereunder disclosed to exemplifying and not limiting purposes.

A machine according to the present invention, generally indicated with 30, comprises a supporting structure 31 bearing a conveyor means 32 for single encoded cards 26, which are fed to it either manually, or directly by a punching and/or encoding maching (not shown).

More precisely, said conveyor means 32 comprises within side guiding walls 33 a roller plane 34, supporting the cards 26, whose motion takes place by friction, due to a ring tape 35 which is positioned on the above, and is powered in 36, in said conveyor means or way 32 means being provided to the purpose of checking and verifying 37 the cards 26, with the possibility of discarding them, if wrong, by means of a selection chute 38.

The end portion of said conveyor means 32 is provided with two supporting plates 39, perpendicular to walls 33 and extending from them, suitable to support the encoded card 26, during its insertion inside the envelope-module 11, pushed by a blade 40, reciprocated by a control arm 41.

A supporting plate 42 supports the strip 12 of envelope-modules 11, and feeds it, making it pass below a printing unit 43, towards a zone of card inserting 26.

Said supporting plate 42 is provided with side guides 44 for the strip 12 which, at least on one side, are also provided with continuous means 45 of separation and opening of the free edges 22, such as e.g., metal plates.

The strip 12 is moved, in the direction of the arrow 46, by means of the friction on underlaying motorized rollers (not shown), and reacting with at least a group of pressure rollers 47, said stepwise motion allowing the insertion action being controlled by means of sensor means 48, able to detect e.g. the holes 25 of the strip, positioning it each time.

In correspondance of the conveyor means 32, the separation means 45 is provided with an opening means 49, facilitating the insertion of the card 26 inside the pouch 20, and with a first sensor meand 50, which verifies and gives its consensus of ended operation.

A heat sealing means 51, positioned e.g. on an elbow support 52, carries out the sealing of the envelope-module 11, acting on the lines of glue 23, after that a second sensor means 53 has verified the presence of the card 26 inside the pouch 20.

A cutting or tearing means 54, positioned after and in cascade with the sealing means 51, separates the single envelope-modules 11, prefectly sealed, making fall them on a conveyor tape 55 which selectively delivers them either to a first container 56 of envelope-modules 11 ready for being dispatched, or to a second container 57 of wrong or in some way faulty envelope-modules.

A control pulpit 58 allow the operator to intervene on the machine 30, at any time whenever necessary, if he observes an anomalous operation, whether detected or not by the proper checking means, restoring or discontinuing, as necessary, the course of the process.

From the foregoing the operating way results fairly clearly of the exemplifying machine disclosed according to the present invention, such operating way being briefly summarized hereinafter. For example at the outlet from a punching and/or encoding machine (not shown in the drawings), the card 26 is taken by a conveyor means 32 and is sent to the insertion station of the envelope-module 11.

Should the card 26 result faulty, either as for the punching or as for the magnetic encoding, the machine can automatically discard it, on the basis of information supplied together with the card itself, e.g., by placing it, by a suitable chute 38, inside a collecting container (not shown).

Contemporaneously to said operations, the strip 12 is fed on the supporting and loading plate 42 towards a printing unit 43, which prints the name and address of the consignee and/or other possible messages 59.

It must be noted to this regard that the data to be printed are not necessarily the same which are contained on the encoded card, even if the consensus to print is received from the card itself; their selection depends on the needs of the user, in that such data are coming e.g. from the external of the system by means of a suitable transmission line, not shown.

In the preferred embodiment, the data pertaining to each card are supplied directly by the machine which generated it.

At the end of the printing, the envelope-module 11 proceeds until it reaches the insertion station of the cards 26, where a suitable arm lever 41, controlled by a sensor means 50 checking the presence of the card inside the envelope, inserts the card inside the pouch 40 provided in the interior of the envelope-module itself. It should be observed that this is the only necessary coupling operation, as the characteristics of the envelope-module used do not require the subsequent and usual coupling operations between the window envelope and the module, nor the folding operations of the latter. The envelope-module 11, containing the card 26, passes at this point through the sealing station of its only open side 18. In the preferred embodiment, a soldering pressor 51, with thermal resistance, carries out the heat sealing of the pre-glued 23 edges 22, thus assuring the tight sealing of the envelope-modules 11.

Such feature fulfils therefore the reservedness requisites of the mailing of this type of documents: anybody indeed who wants to appropriate the card 26 has indeed to tear the envelope, irreparably damaging it, and will not be able as well to dispatch it later on, owing to the difficulty of having available the same envelope-module, and, anyway, to the impossibility of printing again on its outside face the name and the address of the consignee, and of tightly heat sealing it.

The roller transfer device 47 makes then further advance the strip and the envelope-module, to the separation station, which, in the preferred embodiment, carries out the cutting and trimming operations. Finally, a conveyor tape 55 unloads the envelope-modules. In the preferred embodiment, the correct envelope-modules are collected in the container 56, and the faulty ones in the container 57.

The control console or pulpit 58 signals, with the aid of displays and lamps, the correct operating of each step of the process, and, in case of blockage, allow the operator to intervene, to restore the normal functional conditions.

In a preferred embodiment, the envelope-module 11 may be sealed on two sides, such sides being only provided with glueing lines 16, so that it can receive the card 26 from the side 18, and from the opposite side a further written message, a personal communication, or a small essentially flat item.

Such additional open side is heat sealed it too in a similar way to side 18, e.g., in the same operational step.

The pouch of tissue paper 20 has the double purpose of housing and protecting the card 26, and of preventing it from freely moving, thus infringing possible regulations directing the dispatching by mail.

Preferably and more simply, said pouch 20 may not be present, it being replaced by means suitable to define a stable housing zone of at least one card, such as e.g., glueing lines, metal fasteners, and so on.

I claim:

1. Method for automatically inserting so-called encoded cards inside of envelopes, said method comprising in sequence the operations of:

automatically feeding a continuous strip of envelope-modules in a stepwise movement, contemporaneously feeding encoded cards to be inserted inside said envelope-modules, printing an address or like data on an outside face of a single envelope-module corresponding to at least an encoded card being fed for insertion into said single envelope-module, inserting at least said pre-printed encoded card inside a corresponding envelope-module, verifying the introduction of the card within the corresponding envelope-module, closing and sealing the envelope-module.

2. Method as claimed in claim 1, wherein the single envelope-modules, sealed and containing the cards are separated from the continuous strip.

3. Method as claimed in claim 2, wherein the separated envelope-modules are divided into correct modules and faulty modules, and the separated envelope-modules are selectively fed to relevant containers or disposing means.

4. Method as claimed in claim 1, wherein further written messages or documents are inserted contemporaneously to the operation of insertion of the encoded card.

5. Method as claimed in claim 1, characterized in that:

said cards to be inserted are automatically fed, the exactness of said cards is verified, possible faulty cards are disposed of.

6. Equipment for inserting encoded cards inside envelopes, said equipment comprising a supporting structure including a support plate, means for feeding a continuous strip of envelope-modules onto said support plate, conveying means and feeding means for conveying and feeding encoded cards towards said support plate, inserting means for introducing single ones of the encoded cards inside the envelope-modules, means for verifying that said insertion of a card has occurred, means for sealing open edges of the envelope-modules, means for separating single envelope-modules from the continuous strip, moving means for moving said continuous envelope-module strip stepwise, said moving means being operatively connected to and coordinated with means for actuating said inserting means, and means for checking and verifying the insertion of a card into an envelope-module.

7. Equipment as claimed in claim 6, together with printing means operationally connected to said card conveying and feeding means, identifying means for identifying an encoded card and for transmitting to said printing means data to be printed on the corresponding envelope-module.

8. Equipment as claimed in claim 6, together with conveying means for selecting and separating single correct and faulty envelope-modules and conveying separated envelope-modules towards respective containers.

9. Equipment as claimed in claim 6, together with means for selectively inserting inside an envelope-module additional manuscripts, personal messages, and small items of essentially flat shape.

10. Equipment as claimed in claim 6, wherein said conveying and feeding means includes a roller conveyor positioned under a motorized ring belt and side walls for receiving and containing cards between said roller conveyor and said motorized ring belt and between said side walls with said cards being moved by friction, and means for reading, identifying and disposing of faulty cards from said conveying means.

11. Equipment as claimed in claim 6, wherein said means for inserting said cards inside envelope-modules includes a blade, said blade acting as pushing means for a single card positioned between guiding walls, and said blade being supported on a reciprocating arm, and means for opening and spacing apart the open edges of envelope-modules.

12. Equipment as claimed in claim 6, wherein said means for verifying the insertion of a card inside an envelope-module include sensor devices placed above an envelope-module in a sliding contact relationship with the envelope-module.

13. Equipment as claimed in claim 6, wherein said sealing means are heat bonding pressure means for acting on pre-glued and coated portions of opposing and open edges of an envelope-module.

14. Equipment as claimed in claim 6, wherein said means for separating individual envelope-modules are of the blade type.

15. Equipment as claimed in claim 6, wherein said means for separating individual envelope-modules are of the pre-cut lines tearing type present on the continuous strip of envelope-modules.

16. Equipment as claimed in claim 6, wherein said supporting plate has means for guiding a continuous envelope-module strip and means for opening opposing, separated and pre-glued edges of the continuous envelope-module strip, and means for controlling the stepwise advancement of a continuous envelope-module strip operationally connected to said inserting means inside envelope-modules and with sensor means controlling said sealing means for sealing the edges.

17. Envelope-module for use in an automatic insertion method, said envelope-module forming a part of a continuous strip and comprising an upper portion and a lower portion connected to each other along at least two pasted sides, said envelope-module having two other sides provided with open edges, and means for defining a zone for stable housing of at least one card.

18. Envelope-module as claimed in claim 17, wherein said means for defining a zone for stable housing of a card is a pouch fixed nearby said open edges on at least one of said portions.

19. Envelope-module as claimed in claim 17, wherein said open edges are pre-glued.

20. Envelope-module as claimed in claim 17, together with pre-cut lines for allowing said pasted sides to be withdrawn.

21. Envelope-modules as claimed in claim 17, wherein said pasted sides are three in number and said pouch is positioned in correspondence of the fourth side which is an open side.

22. Envelope-module as claimed in claim 17, wherein said envelope-module is connected to other similar modules through pre-cut and folding facilitating lines.

23. Envelope-module as claimed in claim 17, wherein said envelope-module is provided with means for stable positioning and verification on withdrawable edges or portions.

24. Envelope-module as claimed in claim 17, wherein said upper and lower portions are provided with preprinted messages or communications on inside surfaces thereof.

* * * * *